US005999133A

United States Patent [19]

Svensson

[11] Patent Number: 5,999,133

[45] Date of Patent: Dec. 7, 1999

[54] RETRACTABLE ANTENNA WITH SHIFTING ELECTRICAL LENGTH

[75] Inventor: Anders Svensson, Dalby, Sweden

[73] Assignee: Telefonaktiebolaget LM Ericsson, Stockholm, Sweden

[21] Appl. No.: 09/045,641

[22] Filed: Mar. 23, 1998

[30] Foreign Application Priority Data

Mar. 24, 1997 [SE] Sweden ..... 9701056

[51] Int. Cl.[6] ..... H01Q 1/24

[52] U.S. Cl. ..... 343/702; 343/900

[58] Field of Search ..... 343/702, 900; H01Q 1/24

[56] References Cited

U.S. PATENT DOCUMENTS

| | | | |
|---|---|---|---|
| 5,204,687 | 4/1993 | Elliott et al. | 343/702 |
| 5,661,496 | 8/1997 | Baek et al. | 342/702 |
| 5,794,158 | 8/1998 | Itoh | 343/702 |
| 5,801,662 | 9/1998 | Itoh | 343/702 |
| 5,835,065 | 11/1998 | Wallace et al. | 343/702 |

FOREIGN PATENT DOCUMENTS

| | | |
|---|---|---|
| 0 516 490 | 12/1992 | European Pat. Off. . |
| 0 613 207 | 8/1994 | European Pat. Off. . |
| 0 634 806 | 1/1995 | European Pat. Off. . |
| 0 736 925 | 10/1996 | European Pat. Off. . |
| 2 308 746 | 7/1997 | United Kingdom . |
| 92/16980 | 10/1992 | WIPO . |
| 97/23014 | 6/1997 | WIPO . |

*Primary Examiner*—Don Wong
*Assistant Examiner*—Hoang Nguyen
*Attorney, Agent, or Firm*—Burns, Doane, Swecker & Mathis, L.L.P.

[57] ABSTRACT

An antenna for small mobile devices comprises an antenna rod retractable in an antenna cover, the rod having an extended position, when the device operates in an active mode, or a retracted position, when the device operates in a passive mode. The electrical length of the antenna is different in the respective modes. Further, the antenna rod comprises an upper section and a lower section, separated from each other by an intermediate electrically insulating portion, wherein the upper section forms an antenna in a passive mode and the two sections in the active mode.

6 Claims, 2 Drawing Sheets

RETRACTABLE ANTENNA WITH SHIFTING ELECTRICAL LENGTH

BACKGROUND

The present invention relates to an antenna for small mobile devices with an antenna rod retractable in an antenna cover, which rod can be in an extendible position, when a terminal operates in an active mode, as well as in a retractable position, when the terminal operates in a passive mode.

There are several and high demands raised on antennas of mobile stations in a modern mobile telephone system. Except for demands on cost efficiency there are demands on long operating time of a mobile station between the recharging of batteries, which means that the electrical energy consumed must be kept low. The energy consumption is influenced by i.a. the efficiency of the antenna.

To meet the requirements from today users, a mobile phone has to be light and compact so that for example it can be stored in an inside pocket in a jacket or carried in a belt by means of a belt-clip. Further, mobile phones are used in different environments and by many different kinds of users, requiring that the telephone has good performance and at the same time is robust and easy to handle.

A mobile station in a modern telecommunication system such as GSM (Global System for Mobile Communications) operates essentially in two modes, an "active" and a "passive" mode. The mobile station is in its active mode during an ongoing call, when the communication is intensive between the mobile station and the present base station, and in the passive mode, the so called stand-by mode or readiness mode, when the mobile station does not serve any ongoing call but some communication with the base station still occurs in regular intervals.

There are several kinds of prior art antennas for mobile stations, such as rod antennas of half wave or quarter wavetype, dipol antennas, coil antennas, helix antennas etc. Different types of antennas have different suitabilities in view of the above described problem perspective. Notwithstanding that the helix antenna does not show as good antenna efficiency as a half wave rod antenna, it is often used because due to its coil shape it can be made compact and durable.

From considerations of space it is further common that mobile phones are provided with retractable antennas, usually completed with separate antennas arranged on the mobile phones for use in readiness state, because a rod antenna fully retracted in a metal casing of an apparatus is isolated from the environment in the meaning of signaling.

EP-A-0 736 925 describes an antenna with dual functions and a mobile phone provided with such an antenna. This antenna has two parts and can operate in two modes, i.e. in an active mode, when the antenna is extended, and a passive mode, when the main part of the antenna is retracted in the casing of the mobile phone.

U.S. Pat. No. 5,204,687 also relates to an antenna which can operate in two modes. The antenna of U.S. Pat. No. 5,204,687 is formed of two conductive elements arranged in series in an elongated antenna structure without galvanic contact with each other. The upper part of the antenna consists of a helix element, and the lower part of the antenna consists of a rod. When the antenna is in its active mode, i.e. the fully extended position, the lower part of the antenna, the rod, operates as an antenna. When the antenna is in its passive retracted position the upper helix element operates as an antenna.

WO92/16980 also describes an antenna, which has dual functions and consists of an upper helix part and a lower rod part. Contrary to the U.S. Pat. No. 5,204,687 antenna the two parts of the antenna co-operates when they are electrically attached to each other. The object of the antenna according WO92/16980 is to dimension the rod part and the cover, in which the rod is located in its retracted position, so that when the antenna operates in the passive mode the rod part constitutes a very high impedance, thereby not influencing the operation of the helix part. An incorrect dimensioned rod part can in its retracted position result in undesired reflections or unnecessary attenuation of the signal.

The object of the invention described in EP-A-0 736 925 is to obtain an antenna structure operating in a suitable way both in retracted position and in extended position and being a small size preferably in mobile telephone systems. Also, it should be easy to produce and be suitable for serial production of mobile stations.

According to what is mentioned above this antenna also consists of two parts electrically attached to each other. The characterizing feature of this antenna is that the length of the lower part of the antenna is essentially less than a quarter of a wave length, at which the antenna is intended to operate, and that the lower part of the antenna in the extended position together with the matching circuit is to be matched to the impedance of the upper part of the antenna, so that it corresponds to the impedance of the antenna port. Thus, the lower part of the antenna is not to be hidden for the signal, which is the case according to WO92/16980. Consequently, the electrical length of the lower part may be considerably less than a quarter of a wave length.

A problem with prior art antennas having a rod portion and a helix portion is the difficulty to mechanically design the antenna so that the requirements of good performance and a compact shape is fulfilled. When the antenna is extended, in many cases the helix section has to be disconnected or compressed in order not to influence the total performance of the antenna. It is also difficult to incorporate the long rod within the telephone if an antenna having an electrical length of a half wave length in extended position is prefered.

SUMMARY

The object of the present invention is to provide an antenna for small mobile devices such as mobile phones, wherein the antenna has a plain mechanical design and at the same time is robust and provides good performance. Further, the antenna according to the invention shall overcome the above mentioned problems of prior art antennas.

This is accomplished by an antenna, comprising only a rod with two separate sections, i.e. an upper and lower section, separated from each other by means of an intermediate insulating part. The antenna can operate in a passive mode, wherein the upper section is located within the antenna cover and operates as an antenna, for example with an electrical length of a quarter wave length, while the lower section is retracted in the casing of the phone and is disconnected, as well as in an active mode, wherein the antenna is extended and the two sections are connected and operate together as an antenna, for example with a half wave electrical length.

Hence, the antenna according to the present invention has two parts, only galvanicly connected to each other in the active mode but not in the passive mode. This distinguishes the invention from the antenna according to EP-A-0 736 925, wherein the two antenna parts are galvanically attached to each other all the time.

The above mentioned advantages of having an antenna divided in two parts and the parts co-operating as described above are not obtained with the two part antenna of U.S. Pat. No. 5,204,687, because the parts in that antenna do not co-operate in the active position.

By having an antenna according to the invention provided with a divided rod antenna, where the parts co-operate, the problems associated with an antenna provided with co-operating helix and lower rod parts, according to WO92/16980, are overcome.

BRIEF DESCRIPTION OF THE DRAWINGS

The present invention will be described in detail in the following description with reference to the accompanying drawings, in which.

DESCRIPTION OF A PREFERRED EMBODIMENT

Figure 1:
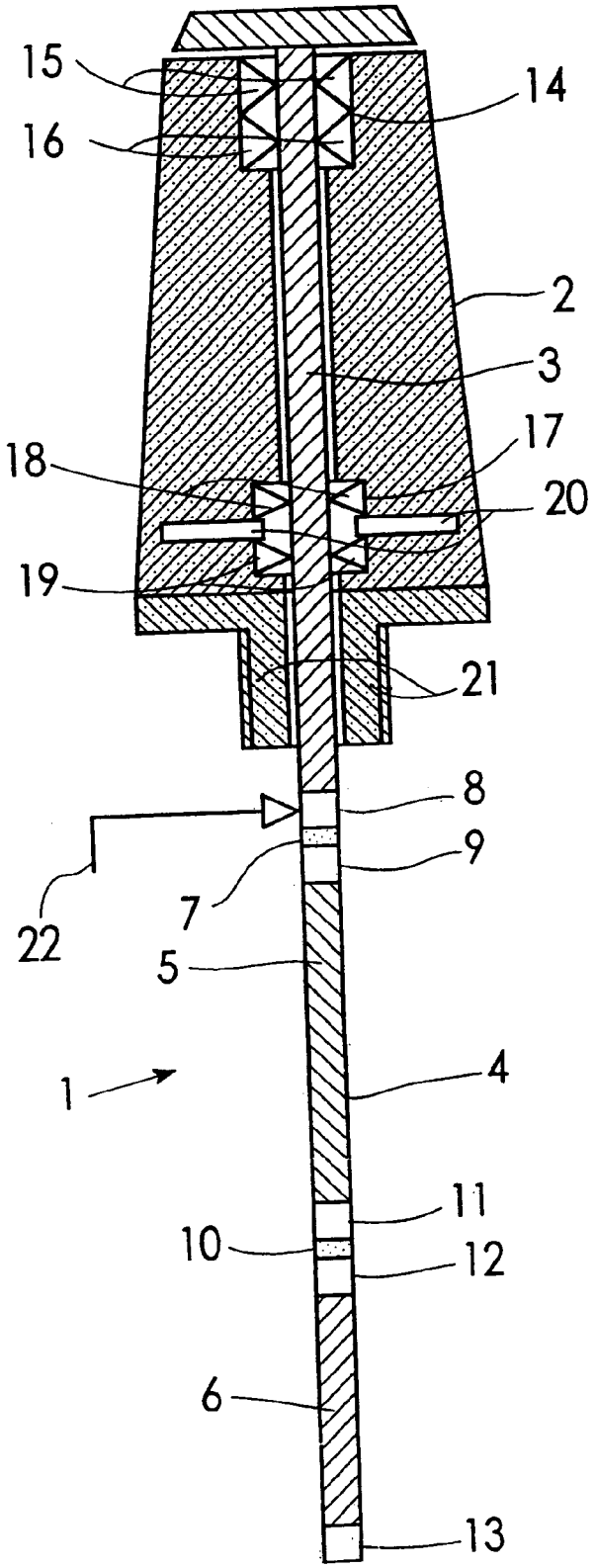
FIG. 1 shows a cross section of an antenna having a rod according to the invention in retracted position.
Figure 2:
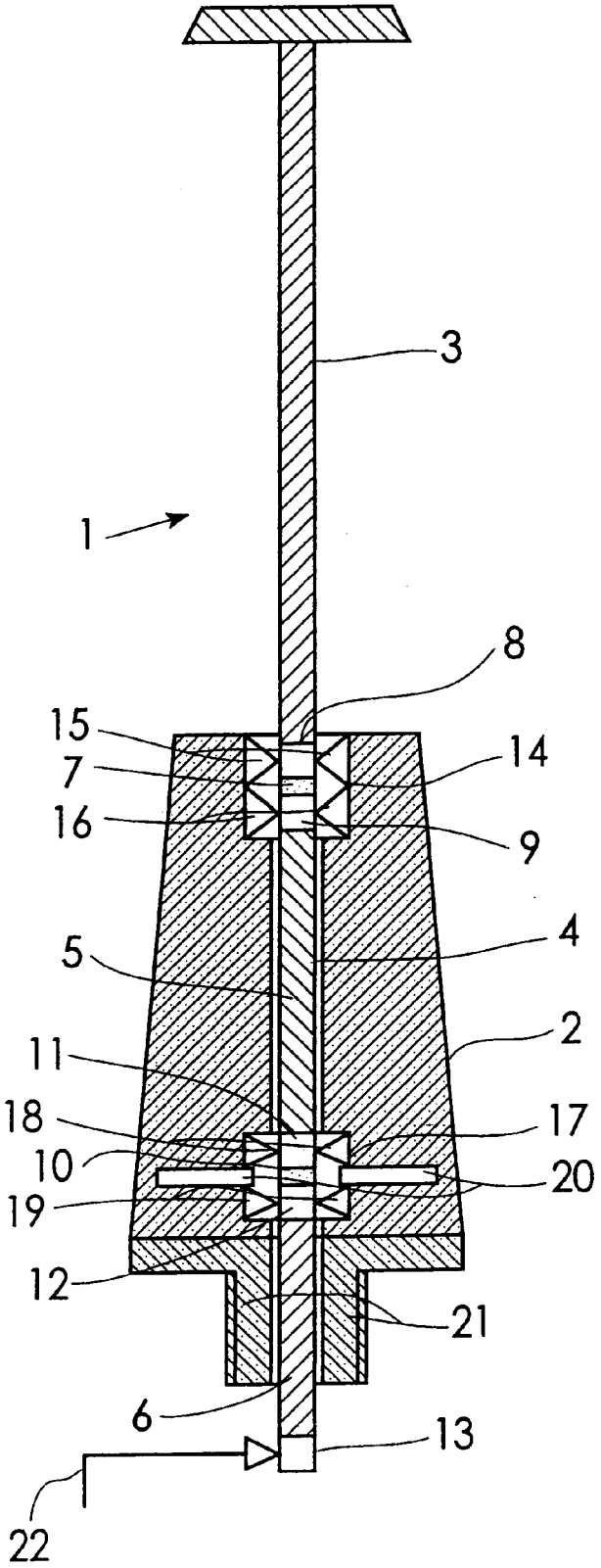
FIG. 2 shows the antenna of FIG. 1 with the rod in an extended position.

FIGS. 1 and 2 show a preferred embodiment of an antenna according to the invention for small mobile terminals, such as mobile phones, the antenna having a plain mechanical design and at the same time being robust and providing good performance.

The antenna comprises a rod 1 retracted in a casing 2. The rod comprises two separate sections, namely an upper section 3 and a lower section 4. In turn, this lower section 4 comprises an upper part 5 and a lower part 6. The upper and lower sections are separated from each other with an intermediate first electrical insulating portion 7. Additionally, the upper section is provided with a first antenna connector 8 and a first connection connector 9 adjacent to the insulating portion 7. In the same way, the upper and the lower parts 5 and 6 are separated from each other with an intermediate second electrical insulating portion 10. The parts 5 and 6 are also provided with corresponding second and third connection connectors 11 and 12, respectively, adjacent to the insulating portion 10. A second antenna connector 13 is arranged at the bottom of the lower section 4.

A first case 14, preferably of metal, comprising two electrically conductive parts, electrically attached to each other, in the embodiment a first pointed part 15 and a second pointed part 16, is arranged in a recess in the upper portion of the cover 2. Further, the cover 2 is provided with a second metal case 17 in its lower portion, that case also comprising two electrically conductive parts but not directly electrically attached to each other, in the embodiment a third pointed part 18 and a fourth pointed part 19.

An impedance matching in the form of an electrical circuit 20, described later, is integrated in the lower portion of the cover 2 and constitutes a connection between the parts 18 and 19.

For the attachment to a mobile station or a mobile phone an attachment means 21 is fixed in the lower part of the cover 2.

The above mentioned object is obtained with the antenna shown in FIGS. 1 and 2.

The antenna according to the invention operates in a passive mode or readiness mode, as shown in FIG. 1, as well as in an active mode, as shown in FIG. 2.

In the passive mode the upper section 3 is retracted in the antenna cover 2 and operates as an antenna, whereby the antenna connector 8, in this position, is attached to an antenna connection 22 of a phone, which is not shown in the drawings but on which the antenna is arranged. In the embodiment, the antenna has an electrical length of a quarter of a wave length. The lower section 4 of the antenna is in this mode retracted in the casing of the phone and is disconnected, whereby, due to the intermediate insulating portion 7, it is separated from and consequently not electrically connected to the upper section 3. Hence, the lower section 4 does not influence the antenna function or performance.

In the active mode shown in FIG. 2 the antenna is extended, and the two sections 3 and 4 are electrically attached to each other by means of the case 14, whereby the pointed part 15 is engaged with the antenna connector 8 and the pointed part 16 is engaged with the connection 9. Thus, the two sections 3 and 4 co-operate in order to form an antenna with an electrical length of a half wave length. In this position, the antenna connector 13 is attached to the antenna connection 22 of the phone.

With an antenna according to the invention, the electrical length of the antenna is shifted in the embodiment to a half wave length, the antenna being independent of a ground plane and thereby being a more robust antenna when used, for example in a mobile phone.

Further, in the passive mode according to FIG. 1 with a quarter wave electrical length, the antenna has an impedance near 50 Ω, which is the desired impedance. In the active position according to FIG. 2, when the antenna has a half wave electrical length, the impedance is higher and therefore a matching is needed. This matching is obtained by means of for example a printed quarter wave length matching on the circuit 20 arranged on a lower part of the cover 2. This matching is connected in the active position in that the pointed part 18 is engaged with the connection 11 and the pointed part 19 is engaged with the connection 12.

The antenna according to the invention is a new technique of shifting the antenna between the active and the passive mode, respectively. By extending the rod 1 and retracting it in the cover 2, respectively, the electrical length of the antenna is shifted. An advantage of the solution according to the invention is that the length of the part of the antenna which has to be incorporated within the phone when the rod is retracted only is a quarter wave length, while the antenna still has half wave length properties in the extended position.

The rod 1 can be a straight or a tightly wound wire or a combination thereof to get a correct length in both the extended and retracted positions. In other embodiments, the electrical length of the antenna can of course be shifted between other lengths than those in the described embodiment. This is obtained by changing the length of the sections of the antenna. For further compression of the antenna, the antenna tip can be a helix antenna in another embodiment.

The cover 2, through which the rod 1 runs, can be of a rigid or flexible material, such as rubber or the like, and have an arbitrary or for the object suitable shape. Further, the case 14, in the active mode connecting the two sections 3 and 4, is fixed in the top of the cover 2. According to the above description, the cover is provided with the attachment means 21 in its lower part for attachment of the antenna to a phone. The attachment means 21 is a threaded connection in the embodiment, but may be a clip connection in another embodiment.

The invention has been described by way of an example to facilitate the understanding of the scope of the invention and should not be understood as a limitation. Thus, the antenna, which has the characterizing features that are intended to be protected, can be designed in other ways and also be different in appearance in other embodiments of the invention, but still be within the scope of the appended claims.

What is claimed is:

1. An antenna for small mobile devices, comprising:

an antenna rod retractable within an antenna cover, the antenna rod having either an extended position when the device operates in an active mode or a retracted position when the device operates in a passive mode, the antenna rod comprising an upper section and a lower section, which are separated from each other; and an intermediate electrical insulating portion between the upper section and the lower section of the antenna rod;

wherein the upper section forms an antenna in the passive mode, and the upper and lower sections together form an antenna in the active mode , the upper and lower sections together in the active mode being electrically connected to each other by means of a first case arranged in a recess in an upper part of the antenna cover;

wherein an electrical length of the antenna operating in the passive mode is different than an electrical length of the antenna operating in the active mode.

2. An antenna according to claim 1, wherein the upper section has an electrical length of a quarter wave length.

3. An antenna according to claim 1, wherein the lower section has an electrical length of a quarter wave length.

4. An antenna according to claim 1, wherein the lower section has an upper part and a lower part, separated from each other by an intermediate electrical insulating portion.

5. An antenna according to claim 4, wherein the cover in its lower portion is provided with a second case connecting the upper part of the lower section with the lower part of the lower section when the antenna is in its extended position.

6. An antenna according to claim 5, wherein the second case has two electrically conductive parts electrically connected to each other, wherein an impedance matching in the form of a circuit is integrated in the lower portion of the cover and constitutes a connection between the two electrically conductive parts of said second case.

* * * * *